US007113718B2

(12) United States Patent
Bobo et al.

(10) Patent No.: US 7,113,718 B2
(45) Date of Patent: Sep. 26, 2006

(54) METHOD AND APPARATUS FOR REDUCING IMAGE ARTIFACTS CAUSED BY RELEASE FLUID IN AN ELECTROPHOTOGRAPHIC MACHINE

(75) Inventors: Robert David Bobo, Ontario, NY (US); Wilbur Charles Kasiske, Penfield, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 60 days.

(21) Appl. No.: 10/836,487

(22) Filed: Apr. 30, 2004

(65) Prior Publication Data

US 2005/0244181 A1 Nov. 3, 2005

(51) Int. Cl.
*G03G 15/20* (2006.01)

(52) U.S. Cl. ..... 399/67; 219/216; 399/328; 399/329

(58) Field of Classification Search ..... 219/216; 347/156; 399/67, 68, 69, 320, 322, 328, 399/329, 341, 400
See application file for complete search history.

(56) References Cited

U.S. PATENT DOCUMENTS

| | | | | |
|---|---|---|---|---|
| 5,436,711 | A * | 7/1995 | Hauser | 399/328 |
| 5,887,234 | A | 3/1999 | Aslam et al. | |
| 5,890,032 | A | 3/1999 | Aslam et al. | |
| 5,937,231 | A | 8/1999 | Aslam et al. | |
| 2003/0091360 | A1 | 5/2003 | Onodera et al. | 399/69 |

* cited by examiner

*Primary Examiner*—Hoang Ngo
(74) *Attorney, Agent, or Firm*—Lawrence P. Kessler

(57) ABSTRACT

An electrophotographic machine includes a fusing station configured for fusing an image to an image substrate by applying fusing process parameters to the image substrate. A controller adjusts the fusing process parameters applied to the image substrate dependent at least in part upon whether the image substrate is to be processed by a glossing station to thereby reduce undesirable image artifacts that result when an image contaminated with release fluid is fused and then glossed.

17 Claims, 4 Drawing Sheets

| TEST RUN NUMBER | PAPER TYPE/WEIGHT (G/SQ M) | NIP OFFSET/ADJUSTMENT RELATIVE TO NOMINAL | GLOSS AT FUSER OUTPUT ($G_{60}$) | GLOSS AT GLOSSER OUTPUT ($G_{20}$) | HAZE | LATENT OIL | RIVERS |
|---|---|---|---|---|---|---|---|
| 1 | 118 gm | 0 | 31 | 62 | 3 | 4 | 3 |
| 2 | 118 gm | −33% | 18 | 74 | 1 | 2 | 1 |
| 3 | 170 gm | 0 | 27 | 67 | 5 | 3 | 3 |
| 4 | 170 gm | −22% | 16 | 84 | 1 | 1 | 1 |
| 5 | 216 gm | 0 | 37 | 72 | 5 | 5 | 1 |
| 6 | 216 gm | −33% | 22 | 84 | 1 | 3 | 1 |
| 7 | 300 gm | 0 | 33 | 75 | 5 | 5 | 1 |
| 8 | 300 gm | −33% | 23 | 88 | 1 | 2 | 1 |

FIG. 3

METHOD AND APPARATUS FOR REDUCING IMAGE ARTIFACTS CAUSED BY RELEASE FLUID IN AN ELECTROPHOTOGRAPHIC MACHINE

FIELD OF THE INVENTION

The present invention relates generally to electrophotographic machines. More particularly, the present invention relates to an apparatus and method for reducing image artifacts caused by release fluid in an electrophotographic machine.

BACKGROUND OF THE INVENTION

Electrophotographic machines, such as, for example, copiers and printers, produce images by forming a latent image charge pattern on a dielectric member. The dielectric member carries the latent image through a developing station wherein pigmented toner particles are drawn by electrostatic attraction onto the latent image charge pattern. An electric field is applied to transfer the image from the dielectric member onto either an intermediate transfer member and then to an image substrate, such as, for example, a piece of paper, or directly from the dielectric member onto the image substrate.

The image substrate is then separated from the dielectric member or intermediate transfer member and transported to a fixing station wherein the image is fixed, such as, for example, by fusing, to the image substrate. The fixing station generally includes one or more heated fusing rollers and one or more opposing pressure rollers which are rotated to pass the image substrate through a nip formed between the rollers. Under the heat and pressure within the nip, the toner particles are fused to the image substrate. The image substrate is then separated from the fusing and/or pressure rollers.

In some electrophotographic machines, particularly machines capable of producing multi-color images, the image substrate carrying the fused image may then be carried to a glossing station wherein the surface finish and/or image gloss are enhanced or manipulated by a glossing process. Generally, the glossing process includes a glossing or finishing belt carrying the image substrate through a nip formed between a heated "glossing roller" and an opposing pressure roller. As will be understood by one of ordinary skill in the art, the term "glossing roller" is not used to indicate that the glossing roller itself provides gloss or finish to the image substrate, but rather is used to indicate the roller is part of or located within the glossing station.

The image carrying substrate and the belt are cooled after the nip and before a release roller in order to prevent offset of the toner or marking particles from the image substrate to the finishing belt. The finishing belt carrying the image substrate typically has a surface with a very smooth and shiny coating that produces image substrates with a similar smooth and shiny surface. Alternatively, the finishing belt carrying the image substrate may have a surface with a textured coating that produces image substrates having a similarly textured surface. The glossing station may be onboard or integral with a particular electrophotographic machine or it may be an off-board accessory.

Release fluid (typically silicon oil) may be applied to the fusing and/or pressure rollers of the fixing station in order to facilitate release of the image substrate from and in order to ensure toner does not adhere to the rollers. The release oil, however, occasionally spreads onto an image substrate and contaminates the image thereon. When the image substrate is processed through the glossing station, release fluid on the image may result in undesirable image artifacts, such as, for example, haze, ghosting, rivers. The release fluid may also cause ripples or wrinkles in the image substrate due to reduced friction in the glossing nip.

Therefore, what is needed in the art is an electrophotographic machine that reduces the likelihood of undesirable image artifacts caused by glossing of an image contaminated with release oil.

Furthermore, what is needed in the art is a process for reducing undesirable image artifacts caused by glossing of an image contaminated with release oil.

SUMMARY OF THE INVENTION

The present invention provides an apparatus and method for reducing image artifacts caused by release fluid in an electrophotographic machine.

The invention includes, in one form thereof, an electrophotographic machine including a fusing station configured for fusing an image to an image substrate by applying fusing process parameters to the image substrate. A controller adjusts the fusing process parameters applied to the image substrate dependent at least in part upon whether the image substrate is to be processed by a glossing station to thereby reduce undesirable image artifacts that result when an image contaminated with release fluid is fused and then glossed.

An advantage of the present invention is that undesirable image artifacts resulting from release fluid are significantly reduced.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein:

FIG. 3 shows experimental results demonstrating the improvement obtained in the quality of images produced by the electrophotographic machine of FIG. 1 and by the method of the present invention.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
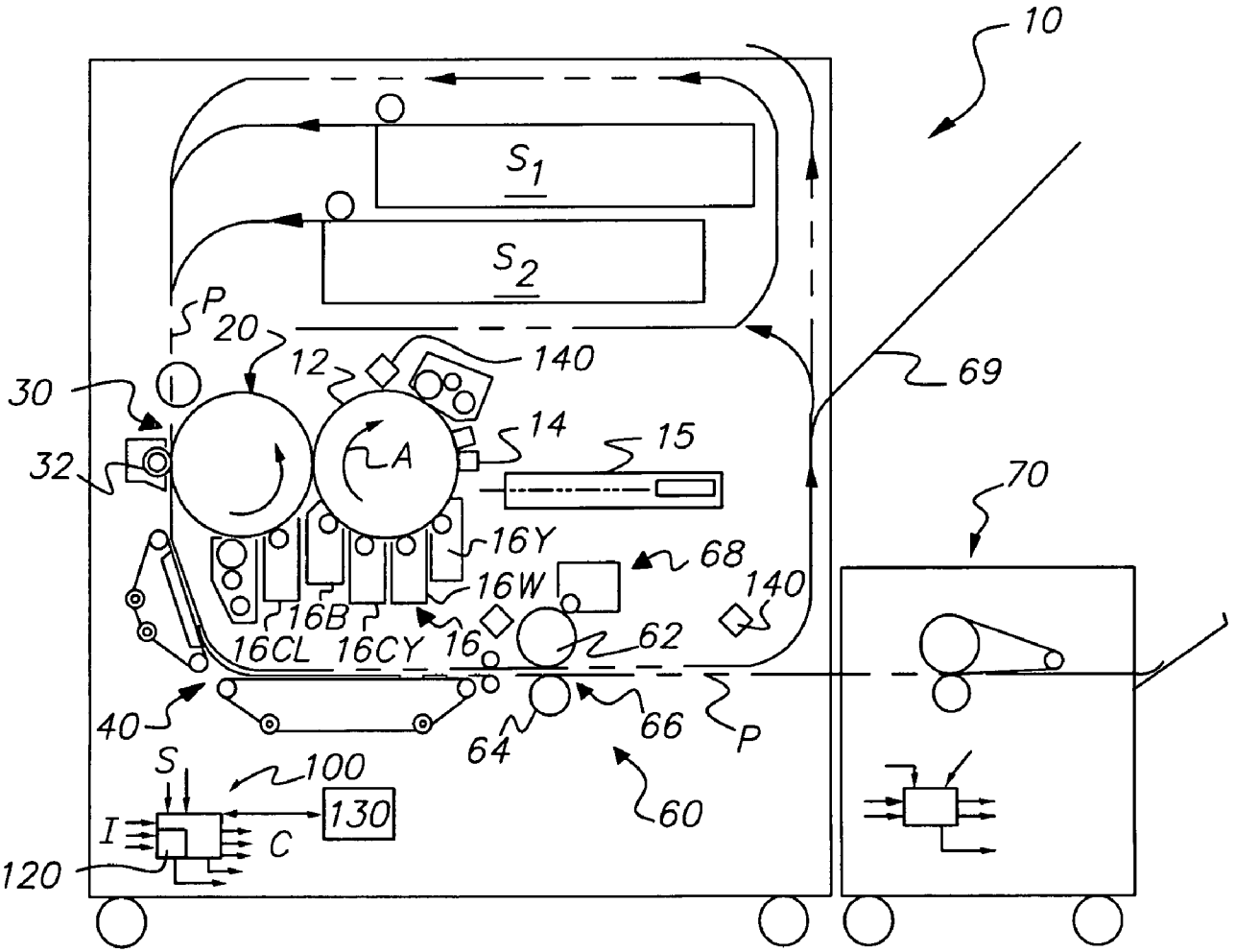
FIG. 1 is a block diagram of one embodiment of an electrophotographic machine of the present invention.

Referring to FIG. 1, an exemplary electrophotographic machine (EM) of the present invention is shown. EM 10 includes photoconductive drum 12, which is rotated in the direction of arrow A and the surface of which is charged to a uniform potential by charging device 14. A light source 15 exposes the surface of photoconductive drum 12 thereby forming a latent electrostatic image thereon. Developing station 16 develops the latent electrostatic image by applying pigmented marking particles (hereinafter referred to as toner) to drum 12.

The exemplary developing station 16 includes five developing units each having a respective color toner associated therewith. More particularly, developing unit 16*y* contains yellow toner, developing unit 16*m* contains magenta toner, developing unit 16*cy* contains cyan toner, developing unit 16*b* contains black toner, and developing unit 16*cl* contains clear toner for use in glossing of images as is more particularly described hereinafter. Generally, each developer unit is individually activated to form respective images on drum 12 which are then transferred to intermediate transfer drum 20. The image on transfer drum 20, in turn, is transferred to an image substrate or receiving member which is transported along dashed-line path P into nip 30, which is formed between image intermediate transfer drum 20 and backing roller 32. The image carried on transfer drum 20 is transferred to the image substrate at nip 30.

Thereafter, transport mechanism 40 transports the image substrate to fusing or fixing assembly 60 which fixes the toner particles to the image substrate by the application of heat and pressure. More particularly, fusing station 60 includes heated fusing roller 62 and an opposing pressure roller 64 that form fusing nip 66 there between. Fusing station 60 also includes a release fluid applicating substation generally designated 68 that applies release fluid, such as, for example, silicon oil, to fusing roller 62.

The image substrate carrying the fused image is transported from fusing station 60 along path P to either a remote output tray 69 or to glossing station 70, or is returned to form the duplex image. In the embodiment shown, glossing station 70 is a stand alone and/or off-line unit. However, it is to be understood that glossing station 70 can be alternately configured as an integral and/or built-in station of EM 10.

Figure 2:
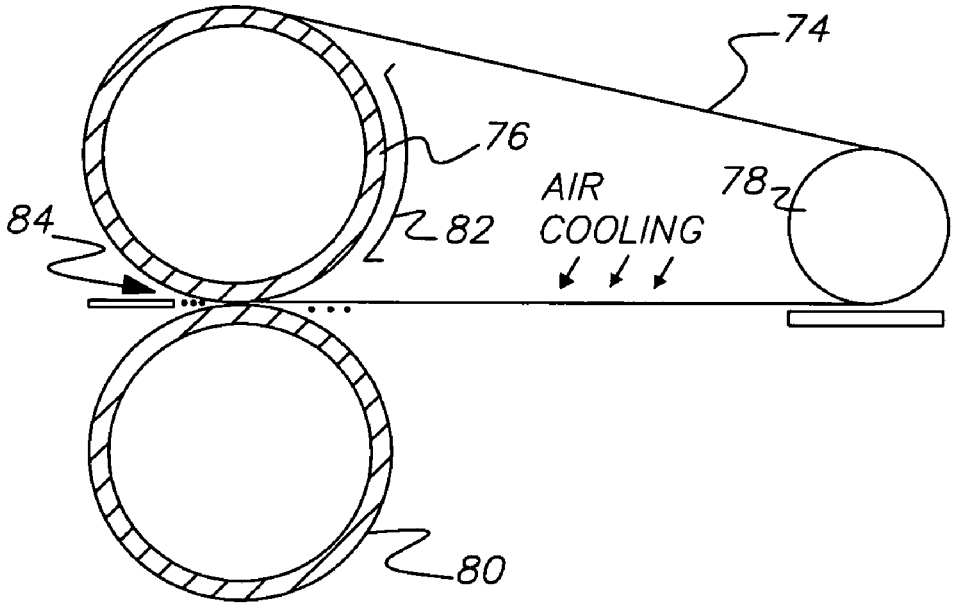
FIG. 2 is a diagram of one embodiment of a glossing station or sub-system of the machine of FIG. 1.

Glossing station 70, as best shown in FIG. 2, includes fusing belt 74, heated glossing roller 76, steering roller 78, pressure roller 80 and heat shield 82. Fusing belt 74 is entrained about glossing roller 76 and steering roller 78. Pressure roller 80 is opposite to, engages, and forms glossing nip 84 with heated glossing roller 76. The finishing belt 74 and image substrate are cooled, such as, for example, by a flow of cooling air, upon exiting the nip 84 in order to reduce offset of the image to finishing belt 74.

Referring again to FIG. 1, EM 10 further includes a first or main logic controller 100, such as, for example, a microprocessor. Controller 100 receives input signals I that are indicative of and/or are based upon input from a user of EM 10. Control software 120 is executable by controller 100 and is stored so as to be accessible thereby, such as, for example, in memory (not shown) of EM 10 or on a remote storage device accessible by controller 100. Parametric look-up table 130 is also stored so as to be accessible by controller 100, such as, for example, in memory (not shown) of EM 10, and is used in the execution of control software 120.

As is known in the art, appropriate sensors generally designated 140 (FIG. 1, only a few of which are shown), such as, for example, mechanical, optical, and electrical sensors, are associated with the various stations and subsystems of EM 10 and produce sensor signals generally designated S that are indicative of the operating parameters of each of those stations and sub-systems. Those sensors 140 and the sensor signals S issued thereby are connected to and received by main logic controller 100.

In use, and generally, EM 10 reduces image artifacts caused by release fluid. Controller 100 executing software 120 and, dependent at least in part upon sensor signals S and input signals I, issues control signals C that adjust the heat and/or pressure within fusing nip 66 so as to reduce image artifacts which are attributable to and/or are the result of release fluid disposed upon and/or impregnating an image substrate that is subsequently processed by/through glossing station 70, and otherwise generally nominalizes and/or optimizes the operating parameters of fusing station 30 for image substrates that are not subsequently processed by/through glossing station 70.

More particularly, controller 100 executing software 120 receives input signals I that are indicative of the type and weight of image substrate or paper that is to be processed by EM 10, and are indicative of whether the paper selected and the images produced thereon are to be processed through or by glossing station 70. Thereafter, controller 100 executing software 120 accesses parametric look-up table 130 and obtains therefrom a set of operating parameters for fusing station 30 that correspond to input signals I and, thus, to the paper to be processed and the processes to be carried out. Controller 100 executing software 120 issues control signals C that correspond to and cause fusing station 60 to operate at the parameters indicated by parametric look-up table 130.

Generally, when input signals I indicate that the image substrate and image carried thereby are to be subsequently processed by glossing station 70 controller 100 executing software 120 issues appropriate control signals C to thereby reduce one or more of the pressure and temperature within fusing nip 66 relative to nominal/optimum fusing process parameters. More particularly, when the image substrate is to be glossed at least one of the pressure with which pressure roller 64 engages heated fusing roller 62 (or the distance separating the central axes of pressure roller 64 and fusing roller 62) and the temperature of heated fusing roller 64 are reduced relative to nominal/optimum fusing process parameters applied to image substrates that will not be glossed. Preferably, the pressure with which pressure roller 64 engages heated fusing roller 62 is the first or primary adjustment since raising and/or lowering the temperature of heated fusing roller 64 is a relatively time consuming process.

Conversely, when the image substrate and image carried thereby are not intended to be processed by glossing station 70, controller 100 executing software 120 issues appropriate control signals C to set one or more of the pressure with which pressure roller 64 engages heated fusing roller 62 (or the distance separating the central axes of pressure roller 64 and fusing roller 62) and the temperature of heated fusing roller 64 to desired and/or optimum fusing process parameters. The desired or optimum fusing process parameters vary dependent at least in part upon whether clear toner/marking particles have been applied to the image substrate, such as, for example, as an overcoat or protective coating that is not to be glossed, or whether no clear toner/marking particles have been applied to the image substrate. In the former, the optimum fusing process parameters are typically increased relative to nominal fusing process parameters, whereas in the latter case the fusing process parameters will be approximately equal to nominal.

Preferably, and as described above, the pressure with which pressure roller 64 engages heated fusing roller 62 is the first or primary adjustment since raising and/or lowering the temperature of heated fusing roller 64 is relatively time consuming.

The reduced fusing process parameters that are applied to an image substrate that is to be glossed results in the image substrates having a top surface that is not entirely sealed.

Any release fluid on the image substrate is therefore desirably able to seep at an increased rate and more completely into the image substrate and into the toner particles forming the image, thereby reducing the occurrence and severity of image artifacts thus increasing the quality of images produced by EM 10. The reduced fusing process parameters merely tack (rather than completely fuse) the image and/or toner particles thereof to the image substrate.

Referring now to FIG. 3, exemplary experimental data are shown that demonstrate the reduction in image artifacts obtained by the method and apparatus of the present invention. As shown therein, four pairs of test runs were conducted to compare the presence and/or amount of undesirable image artifacts produced when an image is fused at nominal conditions and then glossed with the presence and/or amount of such artifacts when an image is fused at nominal fusing conditions and then glossed. Generally, table 4 shows that reducing the pressure of the fusing nip results in a significant reduction in the undesirable image artifacts commonly referred to as haze, latent oil and rivers that result when an image contaminated with release fluid is glossed.

The presence and/or quantity of the undesirable image artifacts of haze, latent oil and rivers was subjectively evaluated and a value of 1 to 5 was assigned to each test run image. A value of 1 corresponds to an image that is virtually free from the particular type of artifact whereas a value of 5 corresponds to an image containing a relatively high incidence of that artifact. The gloss obtained for each image was first evaluated at the output of the fusing station 60 and again at the output of glossing station 70, with the results indicated in corresponding columns in FIG. 4. Gloss at the output of fusing station 60 was measured at an angle of 60 degrees from vertical whereas gloss at the output of the glossing station 70 was measured at an angle of 20 degrees from vertical.

Comparing the data obtained in runs 1 and 2, it is seen that reducing the pressure within the fusing nip used to produce the image of test run number 2 by approximately 33 percent below the nominal value used to produce the image of run number 1 significantly reduced the undesirable image artifacts of haze, latent oil and rivers as indicated in the columns corresponding thereto. Test runs 3 and 4 were conducted using a heavier paper than test runs 1 and 2. By reducing the pressure within the fusing nip in run number 4 by approximately 22 percent relative to the nominal value used to produce the image of run number 3 the presence of undesirable image artifacts was significantly reduced in the image of run number 4 relative to the image of run number 3. Comparing run 5 with run 6 and run 7 with run 8 shows that similar desirable reductions in image artifacts are achieved when using heavier papers.

It should be particularly noted that the optimum magnitude of the reduction in fusing nip pressure that achieves a desired reduction in undesirable image artifacts is at least in part dependent on various factors, such as, for example, the weight of the paper and the configuration and nominal operating parameters of the particular electrophotographic machine. The optimum percentage reductions for any particular application that achieve the desired reduction in image artifacts can be simply and expediently determined by one skilled in the art having the benefit of this disclosure. The percentage reductions of fusing nip pressure discussed herein are merely exemplary and should not be considered limiting in any manner.

In the specific exemplary embodiments shown and discussed above in regard to FIG. 3, undesirable image artifacts are reduced by reducing the pressure within the fusing nip of an electrophotographic machine for images that are to be subsequently glossed. However, it is to be understood that the method and apparatus of the present invention can be alternately configured to reduce the temperature of the fusing station and/or fusing rollers (either alone or in conjunction with a reduction in the pressure of the fusing nip) when processing image substrates that are to be subsequently glossed to thereby achieve similar reductions in the presence of image artifacts.

Figure 4:
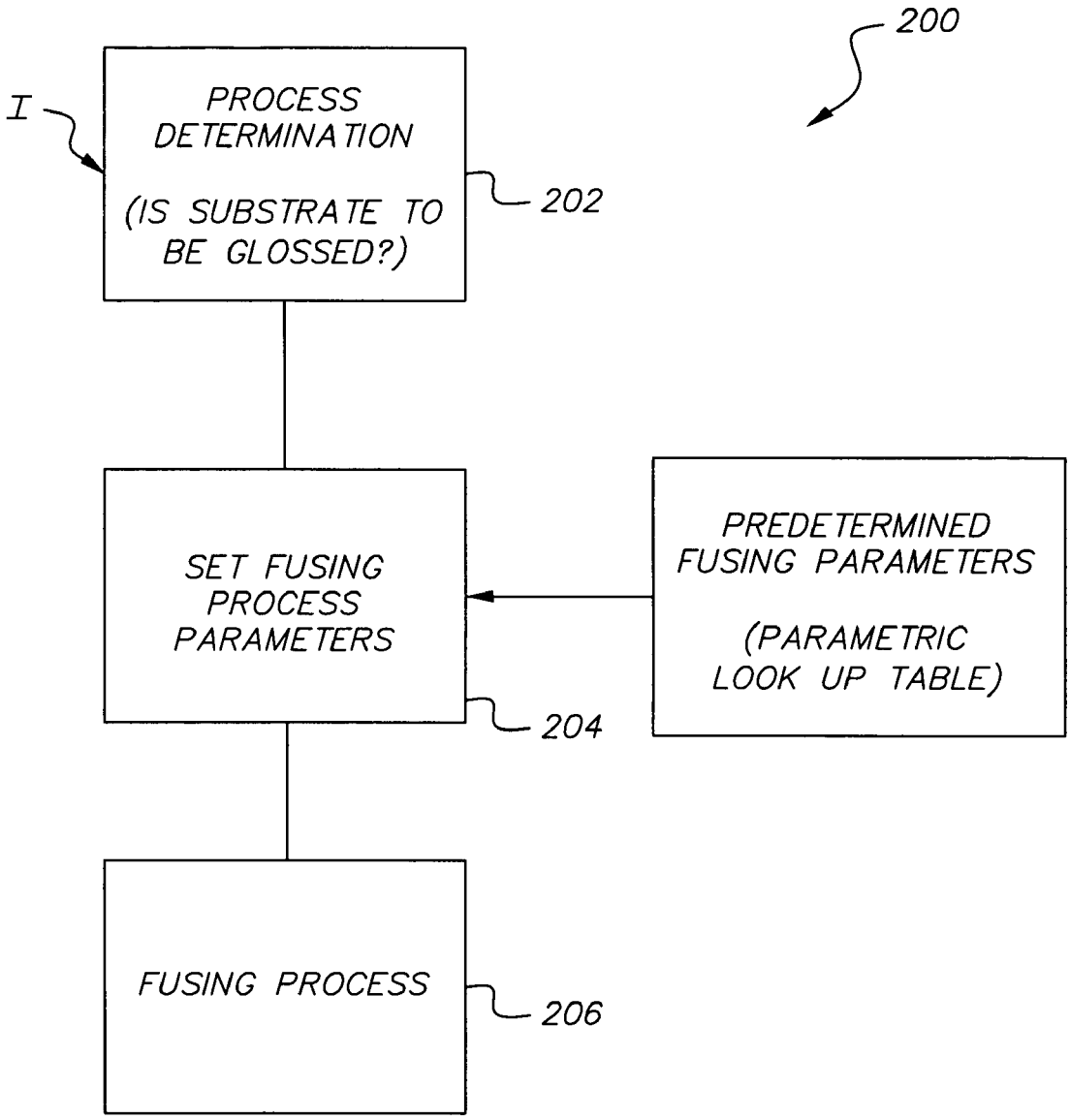
FIG. 4 is a diagram of one embodiment of a method for reducing image artifacts caused by release fluid in an electrophotographic machine of the present invention.

Referring now FIG. 4, one embodiment of a method for reducing image artifacts caused by release fluid in an electrophotographic machine of the present invention is shown. Method 200 is, in the exemplary embodiment of EM 10 shown herein, embodied by and/or within software 120 as executed by controller 100. Generally, and as was described above in regard to EM 10, method 200 adjusts the parameters of the fusing process to reduce image artifacts which are attributable to and/or are the result of release fluid disposed upon and/or impregnating an image substrate that is subsequently processed by/through a glossing station, and otherwise generally nominalizes/optimizes the fusing process parameters for image substrates that are not intended to be subsequently processed by/through a glossing station.

Method 200 includes the processes of Process Determination 202, Setting the Fusing Process Parameters 204, and Fusing 206. Process Determination 202 includes determining whether clear toner/marking particles will be applied to an image substrate and whether the image substrate will be exposed to a glossing process. In some cases, whether or not an image substrate will be exposed to a glossing process can be inferred based upon the type of image substrate being processed. In the exemplary embodiment of EM 10 shown herein, input signals I are inputs to and the basis for Process Determination 202, and are indicative of whether clear toner/marking particles are to be applied to an image substrate, whether glossing of the image substrate is to be conducted and/or of the weight or type of image substrate to be processed.

Setting the Fusing Process Parameters 204 includes the processes of determining and/or retrieving the desired fusing process parameters that correspond to the particular type of image substrate being processed and the processes to which the image substrate will be exposed. Generally, Setting the Fusing Process Parameters process 204 includes setting the fusing process parameters to one of a nominal value, an increased valve relative to nominal, or some reduced value relative to nominal dependent at least in part upon Process Determination 202.

More particularly, the fusing process parameters (i.e., one or more of the fusing pressure and/or fusing temperature) to which an image substrate is exposed are set to nominal/optimal values when clear toner/marking particles have not been applied to the image substrate and when that image substrate is not to be subsequently exposed to a glossing process. The one or more fusing process parameters to which an image substrate is exposed are reduced relative to the nominal/optimum values when clear toner/marking particles have been applied to the image substrate and when that image substrate is to be subsequently exposed to a glossing process. The one or more fusing process parameters to which an image substrate is exposed are increased relative to the nominal/optimum values when clear toner/marking particles have been applied to the image substrate and that image substrate is not to be subsequently exposed to a glossing process.

In the exemplary embodiment of EM 10 shown herein, Fusing Parameter Determination includes the execution of control software 120 by controller 100, and the retrieval from parametric look-up table 130 of a set of fusing process parameters that correspond to the results obtained by Process Determination 202.

Setting the Fusing Process Parameters 204 further includes setting or adjusting the fusing process parameters to correspond to the values indicated and/or retrieved. In the exemplary embodiment of EM 10 shown herein, Setting the Fusing Process Parameters 204 also includes the issuance of control signals C by controller 100 to fusing station 60 to thereby cause the components of fusing station 60 to operate at the desired/retrieved fusing process parameters.

Fusing 206 simply involves exposing the image substrate to the fusing process parameters set by process 204. In the exemplary embodiment of EM 10 shown herein, Fusing Process 206 includes processing of the image substrate through fusing station 60.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

PARTS LIST

| | |
|---|---|
| 10. | Electrophotographic Machine |
| 12. | Photoconductive Drum |
| 14. | Charging Device |
| 15. | Light Source |
| 16. | Developing Station |
| 16y | Developing Unit - Yellow |
| 16m | Developing Unit - Magenta |
| 16cy | Developing Unit - Cyan |
| 16b | Developing Unit - Black |
| 16cl | Developing Unit - Clear |
| 20 | Intermediate Transfer Drum |
| 30 | Nip |
| 32 | Backing Roller |
| 40 | Transport Mechanism |
| 60. | Fusing Station |
| 62. | Heated Fusing Roller |
| 64. | Pressure Roller |
| 66. | Fusing Nip |
| 68. | Release Fluid applicating substation |
| 69. | Output Tray |
| 70. | Glossing Station |
| 74. | Fusing Belt |
| 76. | Glossing Roller |
| 78. | Steering Roller |
| 80. | Pressure Roller |
| 84. | Glossing Nip |
| 100. | Main Logic Controller |
| 120. | Control Software (EM 10) |
| 130. | Parametric Look-up Table |
| 140. | Sensors |
| A | Arrow |
| S | Sensor Signals |
| C | Control Signals |
| I | Input Signals |

What is claimed is:

1. An electrophotographic machine, comprising:

a fusing station configured for fusing an image to an image substrate by applying fusing process parameters to the image substrate and a glossing station for selectively subsequently processing the image substrate;

a controller adjusting at least one of said fusing process parameters, including fusing pressure dependent at least in part upon whether the image substrate is to be processed by a glossing station subsequent to said fusing station, said controller reducing said fusing pressure by approximately twenty percent to approximately forty percent relative to a nominal fusing pressure when the image substrate is to be subsequently processed by said glossing station.

2. The electrophotographic machine of claim 1, wherein said controller receives input signals indicative of whether the image substrate is to be glossed.

3. The electrophotographic machine of claim 2, further comprising a parametric look-up table accessible by said controller and containing a plurality of predetermined fusing process parameters.

4. The electrophotographic machine of claim 3, wherein said controller adjusts at least one of said fusing process parameters dependent at least in part upon whether a clear toner has been applied to the image substrate.

5. The electrophotographic machine of claim 4, wherein said fusing process parameters include fusing temperature and fusing pressure.

6. The electrophotographic machine of claim 5, wherein said controller adjusts at least one of said fusing process parameters to an increased value relative to a nominal value when clear toner has been applied to the image substrate and the image substrate is not to be processed by said glossing station.

7. The electrophotographic machine of claim 5, wherein said controller adjusts at least one of said fusing process parameters to a reduced value relative to a nominal value when clear toner has been applied to the image substrate and the image substrate is to be subsequently processed by said glossing station.

8. The electrophotographic machine of claim 5, wherein said controller adjusts at least one of said fusing process parameters to a nominal value when clear toner has not been applied to the image substrate and the image substrate is not to be subsequently processed by said glossing station.

9. A method for reducing image artifacts caused by release fluid in an electrophotographic machine, the method comprising:

determining whether an image substrate is to be glossed;

setting one or more fusing process parameters dependent at least in part upon said determining step;

when it is determined that an image substrate is to be glossed, blocking application of release fluid during fusing step; and fusing the image to the image substrate by exposing the image substrate to the fusing process parameters.

10. The method of claim 9, wherein said setting one or more fusing process parameters includes setting one or more of said fusing process parameters to a nominal value when said determining step indicates the image substrate is not to be subsequently glossed.

11. The method of claim 9, wherein said setting one or more fusing process parameters includes setting one or more of said fusing process parameters to a reduced value relative to a nominal value when said determining step indicates the image substrate is to be subsequently glossed.

12. The method of claim 11, wherein one or more of said fusing process parameters includes fusing pressure and fusing pressure is reduced by approximately twenty percent to approximately forty percent relative to a nominal fusing pressure.

13. The method of claim 9, wherein said determining step further comprises determining whether clear toner is to be applied to the image substrate prior to said fusing process.

14. The method of claim 13, wherein said setting one or more fusing process parameters comprises setting one or more of said fusing process parameters to an increased value relative to a nominal value when said determining step indicates the image substrate is not to be glossed and that clear toner has or will be applied to the image substrate.

15. The method of claim 13, wherein said setting one or more fusing process parameters comprises setting one or more of said fusing process parameters to a reduced value relative to a nominal value when said determining step indicates the image substrate is to be glossed and that clear toner has been or will be applied to the image substrate.

16. The method of claim 15, wherein one or more of said fusing process parameters are reduced by from approximately ten percent to approximately forty percent.

17. The method of claim 13, wherein said setting one or more fusing process parameters comprises setting one or more of said fusing process parameters to a nominal value when said determining step indicates the image substrate is not to be glossed and that clear toner has not been or will not be applied to the image substrate.

* * * * *